United States Patent [19]

Fontana

[11] Patent Number: 4,619,022

[45] Date of Patent: Oct. 28, 1986

[54] DOUBLE-SAFETY CATCH FOR A BRACELET

[75] Inventor: Fernando Fontana, Sesto Calende, Italy

[73] Assignee: Omega SA, Switzerland

[21] Appl. No.: 710,805

[22] Filed: Mar. 12, 1985

[30] Foreign Application Priority Data

Mar. 20, 1984 [IT] Italy ..... 20157 A/84

[51] Int. Cl.[4] ..... A44B 11/28

[52] U.S. Cl. ..... 24/69 J; 24/71 J; 24/70 J; 24/589; 24/685

[58] Field of Search ..... 24/69 R, 69 ST, 69 CT, 24/69 CF, 69 J, 68 R, 70 TT, 70 T, 70 ET, 70 R, 70 ST, 70 J, 71 J, 71 R, 71 SB, 71 TD, 71 CT, 589, 598, 609

[56] References Cited

U.S. PATENT DOCUMENTS

| | | | |
|---|---|---|---|
| 1,749,036 | 3/1930 | Kuehne | 24/71 J |
| 1,749,997 | 3/1930 | Carlson | 24/71 J |
| 1,852,462 | 4/1932 | Johnson | 24/71 J |
| 3,913,182 | 10/1975 | Fontana | 24/71 J |
| 3,992,757 | 11/1976 | Danna | 24/598 X |

FOREIGN PATENT DOCUMENTS

| | | | |
|---|---|---|---|
| 1325860 | 3/1963 | France | 24/589 |
| 686720 | 3/1965 | Italy | 24/68 J |
| 144369 | 3/1931 | Switzerland | 24/70 J |
| 334751 | 12/1958 | Switzerland | 24/69 J |
| 353927 | 6/1961 | Switzerland | 24/589 |
| 1256965 | 12/1971 | United Kingdom | 24/589 |

*Primary Examiner*—William E. Lyddane
*Assistant Examiner*—Laurie K. Cranmer
*Attorney, Agent, or Firm*—Griffin, Branigan, & Butler

[57] ABSTRACT

A double-safety catch for a bracelet, for example a watch bracelet, has a first closure element pivotally mounted at one end of a first portion of the bracelet for swinging about an axis transverse to the length of the bracelet. The first closure element passes through an opening in the end of the second portion of the bracelet and has a projecting catch which prevents accidental withdrawal of the first closure element from the opening and serves for locking resilient engagement with a rib on the first portion to trap the end of the second portion. A second closure element is pivotable about an axis extending longitudinally of the bracelet to cover the first closure element and to engage with a spring locking device which is manually releasable.

12 Claims, 3 Drawing Figures

20
III
22
21
12
15
3
III
11
4
1
8
10
II
18
7
6
13
5
23
17
16
2
II a
23
6
25
24
a1
26

22
20

27
28
21
29

DOUBLE-SAFETY CATCH FOR A BRACELET

BACKGROUND OF THE INVENTION

The present invention relates to a double-safety catch or clasp for connecting the two portions of a bracelet, in particular for a wristwatch.

In addition to the fact that a catch which is referred to as a safety catch must be such that it can be easily operated, it must also comply with at least two basic conditions. Firstly, it must be such as to permit the bracelet first to be easily fixed on the wrist in such a way that there is no danger of its being dropped during that operation. Then, once the bracelet has been definitively closed, any movement of the wrist or the hand or the action of clothes covering the wrist must not in any circumstance result in untimely opening of the catch.

The former of these conditions is met by means of a catch which is referred to as a flap-over catch wherein each of the portions of the bracelet is joined to the other by two pivotally connected segments which can be folded over one onto the other. The second of the above-indicated conditions is generally fulfilled by using various forms of pawl-type catches or clasps.

Such a construction which fulfills the above-mentioned conditions is described in French utility certificate application No FR-A-2 478 970. That construction comprises two segments which are pivotally connected together and which can be folded one onto the other, with the free ends of each of the segments being attached to respective ones of the portions of the bracelet. After the two segments have been brought into a superposed position relative to each other, a latching hook which is fixed with respect to one of the free ends is forced to engage into a locking device which is fixed with respect to the other free end. That device comprises a manually actuable detent member slidable in a housing against the return force of a spring. The housing and the detent member each comprise a hole, with the holes being slightly offset with respect to each other. When the latching hook engages into the holes, it displaces the detent member until the face of the latter is disposed facing the notch defined by the latching hook. At that moment, the detent member is returned to the position in which it locks the latching hook. To free the latching hook, simply acting on the detent member by means of a finger can cause the catch to open. In that respect, the above-described arrangement meets the safety requirement which has been set as an aim to be achieved, as any untimely movement will not result in the catch opening. However, it suffers from the disadvantage of using two more or less rigid segments, which is rather uncomfortable on the wrist, which is not aesthetically attractive, while at the same time being poorly suited to a bracelet of refined design, which is often made of precious metal.

SUMMARY OF THE INVENTION

To remedy the above-indicated disadvantages, the catch according to the present invention avoids using the two segments referred to above, while enjoying an excellent safety action. For that purpose, it is characterised in that the end of the first portion of the bracelet comprises a first closure element which is pivoted about a first axis perpendicular to the longitudinal direction of the bracelet to trap the end of the second portion and a second closure element which is pivoted about a second axis extending in the longitudinal direction of the bracelet, said second element being arranged, once it has been pivoted over, to cover said first element.

Swiss Pat. No. 623 466 already discloses a clasp or catch provided with a closure element having a pivot mounting parallel to the lengthwise direction of the bracelet. However, that is a catch for a flexible band or strap, where the free portion of the bracelet must be hooked onto a lug or stud before the closure element is pivoted over. That mode of operation however does not ensure that the bracelet is securely fastened before the closure element is folded over, so that there is a risk of the bracelet being dropped.

DETAILED DESCRIPTION OF THE INVENTION

Figure 1:
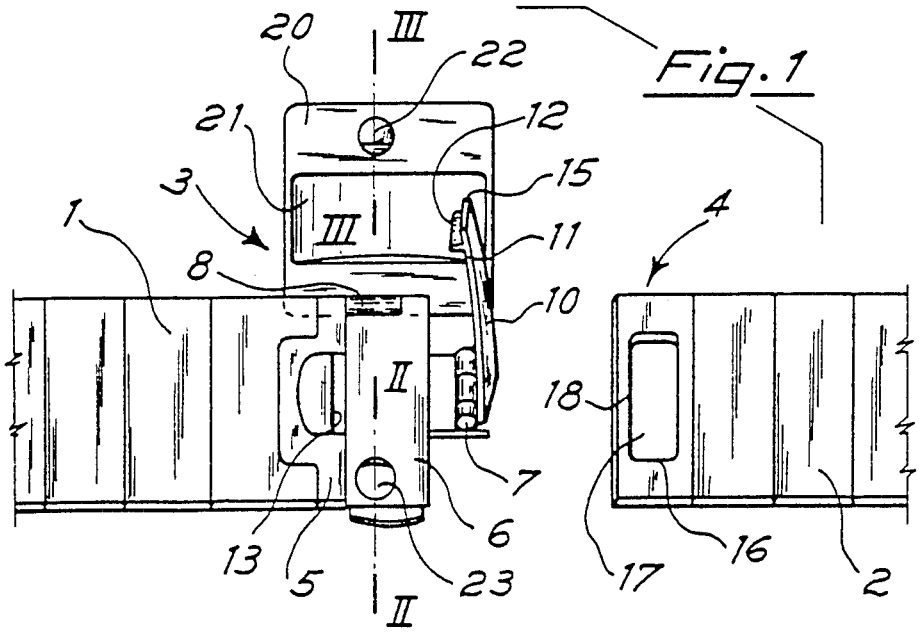
FIG. 1 shows a perspective view of the catch according to the invention in the open condition, a metal link-type bracelet being attached thereto.

FIG. 1 is a perspective view of the catch or clasp according to the invention. The bracelet comprises two portions 1 and 2 which are each formed by a succession of links which are pivotally connected together. The end 5 of the first portion 1 carries a system 3 comprising a first closure element 10 which is mounted pivotably about a first axis 7 which is perpendicular to the longitudinal direction of the bracelet. That element is so arranged as to trap the end 4 of the second portion 2 of the bracelet. The system 3 further comprises a second closure element 20 which is pivoted about a second axis 8 extending in the longitudinal direction of the bracelet.

A preferred construction of the invention, which is based on the above-indicated principle, will now be described.

The first closure element comprises a tongue portion 10 which is pivoted about a hinge 7 disposed perpendicularly to the longitudinal direction of the bracelet. The tongue portion and the hinge are so designed that the tongue portion cannot be turned round towards the rear, its open angular position being approximately that shown in FIG. 1. The hinge 7 is fixed with respect to the end 5 of the portion 1 of the bracelet. At its free end 11, the tongue portion 10 has a small catch portion 12. After the tongue portion has been pivoted towards the portion 1 of the bracelet, the catch portion 12 co-operates with a rib 13 which is carried by the end of the bracelet, thereby to latch the tongue portion in the closed position, by notch engagement. The tongue portion further carries an edge portion 15 which will be used for releasing it, for example by means of a finger nail.

As will be seen from FIG. 1, the end 4 of the second portion 2 of the bracelet is provided with a rectangular opening 17 which is intended to be fitted over the tongue portion 10. The opening 17 will be made of lengths 18 and widths 16 such that the end 4 is perfectly centered about the hinge 7. Once the end 4 has been set in position, the tongue portion is pivoted over it, whereby the first portion of the bracelet is held connected to the second portion; that constitutes the first safety closure afforded by the catch. As the tongue portion cannot pivot round to the rear and as on the other hand it carries the catch portion 12 referred to above, it will be appreciated that, once the opening 17 has been fitted over the tongue portion 10, it will no longer be possible for the opening 17 to slip off its position of engagement on the tongue portion.

The second closure element comprises a plate 20 which is pivoted about a hinge 8 disposed in the longitudinal direction of the bracelet or, if it is preferred, disposed perpendicularly to the hinge 7. When the tongue portion 10 has been pivoted about the hinge 7, the plate 20 can then be pivoted down over the top of the tongue portion 10.

FIG. 1 shows that the plate 20 is provided with a recess 21 in which the tongue portion 10 is housed, in order thereby to minimize the height of the catch. In addition, at its free end, the plate 20 carries a latching hook 22 which is capable of notching engagement on a locking device 6.

Figure 2:
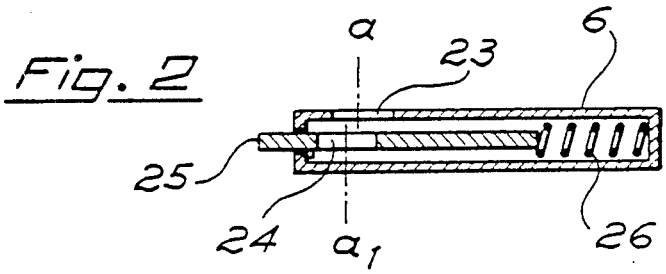
FIG. 2 is a view of the locking device in section taken along line II—II in FIG. 1.
Figure 3:
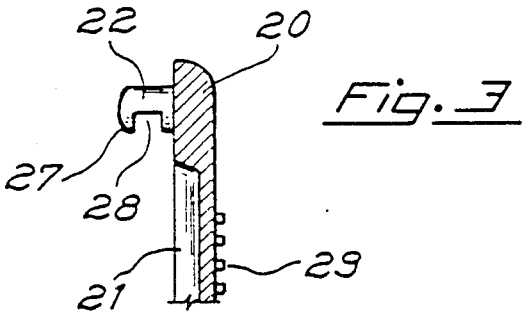
FIG. 3 is a view of the closure element in section taken along line III—III in FIG. 1.

The locking device 6 may take different forms. A preferred embodiment is shown in FIGS. 1, 2 and 3. In this embodiment, the locking device 6 comprises a detent member 25 which is manually actuable and which is subject to the action of a spring 26. The device 6 and the member 25 are each provided with a respective hole 23 and 24. In the rest position, the holes are slightly offset, as indicated by the axes designated by a and $a_1$. The hook 22 firstly engages into the hole 23 in relation to which it is centered. When it reaches the hole 24 in the member 25, the nose portion 27 thereof causes the member 25 to slide towards the right until the edge of the member 25 is disposed facing the notch 28 defined by the hook 22. At that moment, the member 25 engages into the notch 28, being urged in that direction by the return spring 26. The closure arrangement is thus locked. From that time on, only an operating movement performed with the finger can re-open the catch. That is the second safety closure means afforded by the catch.

It will be noted that, when the catch is re-opened, the first operation, which could be performed inadvertently, does not involve any danger of the bracelet dropping off since it is still necessary to release the tongue portion 10 in order to separate the two portions 1 and 2 of the bracelet. There is therefore proposed a catch which affords a maximum guarantee in regard to safety of closure, while being freed of the need to use rigid segments in respect of which it has been said that they lack aesthetic appeal and are disagreeable.

It will also be mentioned that the upper face 29 of the plate 20 may bear decorative patterns or motifs such as a monogram or precious stones, in order to personalize and to improve the look of the bracelet.

What I claim is:

1. A double-safety catch for connecting a first bracelet portion and a second bracelet portion, the catch having an assembly for attachment to the first bracelet portion and comprising: first and second closure elements, said first closure element being pivotally mounted in said assembly to pivot about an axis perpendicular to the longitudinal direction of the bracelet portions to trap an end member of the second bracelet portion and said second closure element being pivotally mounted in said assembly to pivot about a second axis extending in the longitudinal direction of the bracelet portions and thereby cover said first closure element.

2. A double-safety catch as claimed in claim 1 comprising first locking means for locking said first closure element in the trapping position.

3. A double-safety catch as claimed in claim 2 wherein said first closure element is a tongue for passage through an aperture in said end member and said first locking means comprises a projecting catch on said tongue and a rib at the end of the first bracelet portion for resilient latching engagement by said projecting catch.

4. A double-safety catch as claimed in claim 3 wherein said second closure element comprises a pivoted plate, a latching hook at the free end of the plate, and a second locking means engageable by the latching hook.

5. A double-safety catch as claimed in claim 4 in which the second locking means comprises a detent member manually displaceable against the action of a biassing spring, said detent member having an opening with which the latching hook co-operates.

6. A double-safety catch as claimed in claim 4 in which said pivoted plate bears decorative motifs on its upper face.

7. A double-safety catch as claimed in claim 1 comprising second locking means for locking said second closure element in the position in which it covers the first closure element.

8. A double-safety catch as claimed in claim 7 wherein said second locking means comprises a latching hook on said second closure element and a locking device engageable by said latching hook, said locking device comprising a latching plate manually displaceable against a spring and having an aperture through which said latching hook passes.

9. A double-safety catch for connecting a first bracelet portion (1) having an end to a second bracelet portion (2) having an end characterized in that the end of the first bracelet portion comprises a first closure element (10) which is pivoted about a first axis (7) perpendicular to the longitudinal direction of said bracelet portion to trap the end of the second bracelet portion and a second closure element (20) which is pivoted about a second axis (8) extending in the longitudinal direction of the bracelet portions, said second closure element being arranged, once it has been pivoted over, to cover said first closure element.

10. A double-safety catch according to claim 9 characterized in that the first closure element comprises a plate (10) which is pivoted at one end about said first axis (7) and which at its other end (11) carries a small catch portion (12) arranged to come into latching engagement on a rib (13) which is carried by the end of the first bracelet portion, one end of the second portion being provided with an opening (17) which is adapted to receive said first closure element and then to be held connected to said first bracelet portion when said first closure element is pivoted over said one end of said second bracelet portion, and said second closure element comprising a plate (20) which is pivoted at one end about said second axis (8) and which, at its other end, carries a latching hook (22) for coming into latching engagement on a locking device (6) carried by the end of the first bracelet portion.

11. A double-safety catch according to claim 10 characterized in that said locking device (6) comprises a detent member (25) which is manually actuable and which is subjected to the thrust force of a spring (26), said detent member (25) having a hole (24) into which the latching hook is brought into latching engagement.

12. A double-safety catch according to claim 10 characterized in that an upper face (29) of the pivoted plate (20) bears decorative motifs.

* * * * *